United States Patent [19]

Hermeyer et al.

[11] 4,439,869

[45] Mar. 27, 1984

[54] X-RAY GENERATOR FOR AN X-RAY TUBE COMPRISING A GROUNDED GRID

[75] Inventors: Bernd Hermeyer, Schenefeld; Heinz Mester, Hamburg; Hans Negle, Nahe, all of Fed. Rep. of Germany

[73] Assignee: U.S. Philips Corporation, New York, N.Y.

[21] Appl. No.: 413,930

[22] Filed: Sep. 1, 1982

[30] Foreign Application Priority Data

Sep. 4, 1981 [DE] Fed. Rep. of Germany ..... 3135061

[51] Int. Cl.[3] ..... H05G 1/12; H05G 1/32

[52] U.S. Cl. ..... 378/113; 378/111; 378/114

[58] Field of Search ..... 378/113, 101, 111, 109, 378/114, 115, 103, 112, 110

[56] References Cited

U.S. PATENT DOCUMENTS 4,333,011 6/1982 Mester ..... 378/111

*Primary Examiner*—Alfred E. Smith
*Assistant Examiner*—T. N. Grigsby
*Attorney, Agent, or Firm*—Paul R. Miller

[57] ABSTRACT

In X-ray tubes comprising a metal grid, it may occur that the necessary emission current cannot be reached in unfavorable circumstances. This situation is improved by the invention in that the high voltage for the X-ray tube is derived from at least three series connected high voltage generators, the first and the second generator being connected to the anode and the cathode, respectively, of the X-ray tube while the third generator can be connected either to the anode side (in the case of high tube voltages) or to the cathode side (in the case of low tube voltage) by means of a switching device.

5 Claims, 2 Drawing Figures

X-RAY GENERATOR FOR AN X-RAY TUBE COMPRISING A GROUNDED GRID

The invention relates to an X-ray generator for an X-ray tube comprising a grounded grid which is situated between the anode and the cathode thereof, said X-ray generator comprising a series connection of high voltage generators which are to be connected to the anode and the cathode of the X-ray tube in order to supply the X-ray tube with a direct voltage, and also comprising means for changing the ratio of the anode voltage and the cathode voltage.

An X-ray generator of this kind is known from DE-OS No. 29 17 636.

An example of X-ray tubes to be powered by the X-ray generator in accordance with the invention is known from the magazine "MEDICAMUNDI", Vol. 25, No. 1, 1980, pages 29 and 30 and from DE-OS No. 28 50 583. X-ray tubes of this kind are also available from Philips under the name "Super Rotalix Ceramic". They deviate from the customary grid controlled X-ray tubes in that the voltage on the metal grid is usually positive with respect to the cathode and can assume very high values which correspond to half the maximum tube voltage or even more. In this type of tube the anode current is smaller than the cathode current, because part of the electrons is incident on the grid after reflection from the anode. The electron current arriving on the anode in such an X-ray tube is determined not only by the cathode temperature but also to a high degree by the voltage between the cathode and the grounded grid; consequently the current through the X-ray tube decreases when the cathode voltage decreases and the cathode temperature remains constant, with the result that fully emission cannot be attained. When use is made of high voltage generators having a very high internal resistance, for example, generators comprising d.c./a.c. converters, there is an additional problem in that the cathode voltage decreases more than the anode voltage when the tube current increases, because the anode current is smaller than the cathode current. Even when the voltage between anode and cathode is maintained at a constant value by means of a suitable control circuit, the cathode voltage per se will decrease and hence also the emission current.

In the X-ray generator disclosed in DE-OS No. 29 17 636 this effect is eliminated in that the high voltage generator, which is connected in series with the high voltage generator on the anode side via a grid-controlled X-ray tube, generates a voltage which is higher than that generated by the high voltage generator on the anode side. The additional steps required for this solution (another grid-controlled tube), however, are very expensive.

It is the object of the invention to provide an X-ray generator of the kind set forth which produces a large emission current also in the case of low tube voltages, without elaborate additional facilities being required.

To this end, the X-ray generator in accordance with the invention is characterized in that the series connection consists of at least three high voltage generators, there being provided a high voltage switching device whereby an output junction of two interconnected high voltage generators can be connected to ground, the high voltage switching device being switchable in dependence of the adjusted value of the tube voltage and/or the tube current in order to ensure that the ratio of the anode voltage and the cathode voltage is smaller in the case of low values of the tube voltage than in the case of high values of the tube voltage and that a given value of the cathode voltage is not exceeded.

Thus, in accordance with the invention at least one of the three high voltage generators is active on the side of the cathode in one position of the high voltage switching device and on the side of the anode in the other position. When the relevant generator is active on the side of the cathode (in the case of comparatively low cathode or tube voltage), the emission current is increased thereby. However, if this high voltage generator were also allowed to be active on the cathode side in the case of high tube voltages (for example, 150 kV), particularly in the case of low tube current settings a high voltage overload could occur on the cathode side where, for example, 100 kV would be present. Therefore, in the case of high tube voltages at which a high voltage overload is liable to occur on the cathode side, this high voltage generator should be active on the anode side.

Thus, the only additional facility required is a high voltage switching device. At least three generators must now be provided instead of the customary two generators, but the generators may now be constructed for lower voltages. For example, when each high voltage generator is formed by a secondary winding of a high voltage transformer whose voltage is rectified by a rectifier device, three secondary windings are required, but these windings may be at least partly constructed for a voltage which is lower than if only high voltage generators were present. The number of rectifier diodes comprised in the rectifier devices is not increased by the presence of three or more rectifier devices in accordance with the invention, because the individual rectifier devices may be constructed at least partly for lower voltages.

The invention will be described in detail hereinafter with reference to the drawings.

Figure 1:
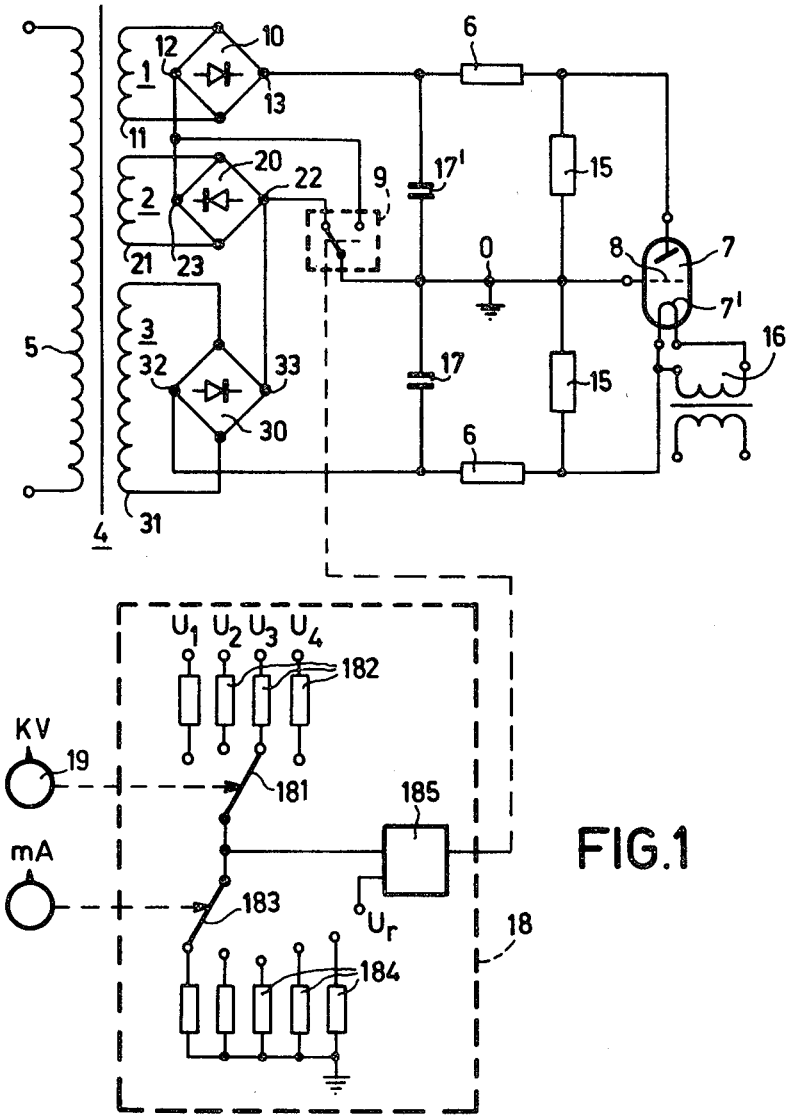
FIG. 1 shows a simplified embodiment.

The three high voltage generators comprise three secondary windings 11, 21 and 31 of a high voltage transformer 4 whose primary winding 5 is connected to a switching and control device (not shown) which enables the formation of voltages of predetermined value on the secondary windings for a predetermined period of time. The secondary windings 11, 21 and 31 form, in conjunction with a rectifier device 10, 20 and 30, respectively, a high voltage generator 1, 2 and 3, respectively. The negative output terminal 12 of the high voltage generator 1 is connected to the positive terminal 23 of the high voltage generator 2 whose negative output 22 is connected to the positive output 33 of the third high voltage generator 3. The positive output 13 of the high voltage generator 1 and the negative output 32 of the high voltage generator 3 are each connected, via a damping resistor 6, to an X-ray tube 7 which comprises a grounded metal grid 8 which is connected to ground 0 between the anode and the cathode. The anode and the cathode of the X-ray tube 7 are each connected to the ground 0 via a voltage divider 15 which serves for the measurement of the tube voltage. The temperature of the filament 7' of the tube 7 is determined by the filament current generated in a filament current transformer 16. Capacitors 17 and 17' which are connected between the outputs 13 and 32, respectively, on the one side and the ground 0 (ground potential) on the other side smooth the voltage on the X-ray tube.

There is provided a high voltage switching device 9 which connects, as desired either the negative output 22 of the high voltage generator 2 or the negative output 12 of the high voltage generator 1 (whose potential is identical to the potential of the positive output of the high voltage generator 2) to the ground 0. In the position of the high voltage switching device 9 which is shown in the drawing the cathode voltage is produced only by the high voltage generator 3 whilst the anode voltage is produced by the high voltage generators 1 and 2. In the second position (not shown) of the high voltage switching device 9, however, the cathode voltage is produced by the high voltage generators 2 and 3 together, whilst the anode voltage is produced only by the high voltage generator 1. In the second (latter) position, the cathode voltage, therefore, is higher in comparison with the anode voltage than in the position shown.

The sum of the output direct voltages of the high voltage generators 1 and 2 should be equal to the output direct voltage of the high voltage generator 3. It would thus be ensured, that in the position of the high voltage switching device, which is shown, the tube voltage is symmetrically distributed between the anode side and the cathode side in the case of small tube currents (for example, during fluoroscopy) and notably also in the case of high tube voltages. The ratio of the output voltages of the high voltage generators 1 and 2, however, should be proportioned in dependence of the internal resistance of the high voltage generator device 1, 2 and 3. The higher the internal resistance thereof, the higher the output voltage of the high voltage generator 2 must be in comparison with the output voltage of the high voltage generator 1. When the primary winding 5 is connected to a d.c./a.c. converter (not shown in the Figure), a comparatively high internal resistance arises, as is known, for example, from that case the secondary windings 11 and 21 preferably comprise the same number of turns and the rectifier devices 10 and 20 preferably comprise the same number of rectifier diodes, so that both high voltage generators 1 and 2 supply equally high output voltages. The output voltage of the high voltage generator 3 should then be equal to the sum of the output voltages of the high voltage generators 1 and 2. It is particularly attractive to form the high voltage generator 3 as the series connection of two high voltage generators which are identical to the high voltage generators 1 and 2. In that case four identical high voltage generators can be used, so that the manufacture is cheaper.

Using the described proportioning of the high voltage generators 1, 2 and 3, the following modes of operation exist for the X-ray tube 7.

(a) Small tube currents (some mA, for example, during fluorscopy).

In the position of the high voltage switching device 9 which is shown in FIG. 1, the anode voltage and the cathode voltage are equal (disregarding the polarity). In the position of the high voltage switching device 9 which is not shown, the cathode voltage will be three times higher than the anode voltage. In the case of very high tube voltages, for example, 150 kV, this could cause an excessive grid/cathode voltage difference, so that a high voltage overload for the X-ray tube 7 arises. Because in the case of (very) small tube currents a decrease of the tube current due to a decrease of the cathode voltage can also be compensated for by an increase of the power to be dissipated in the filament 7' of the X-ray tube, the switching device 9 will not be used in the event of a high voltage overload of the X-ray tube 7, so that the device is continuously operated in the position of the high voltage switching device 9 which is shown.

(b) Large tube currents (a few hundreds of mA and higher, for example, for radiographs).

Even though the no-load voltages on the output terminals 13 are 32 are equal in the position of the high voltage switching device 9 which is shown, the cathode voltage is lower than the anode voltage in the case of large tube currents. This effect is caused on the one hand by the high internal resistance (as already explained) and on the other hand by the fact that the cathode current is larger than the anode current, because part of the electrons emitted by the cathode is reflected to the grid 8 by the anode. Consequently, even in otherwise the same circumstances (copper cross-section, number of turns, etc), the voltage decrease on the cathode side is larger than that on the anode side and the voltage distribution is asymmetrical. Notably in the case of low tube voltages, the voltage on the cathode is thus liable to become so low that the desirable large tube current cannot flow. In that case the switching device 9 must be switched over to the position which is not shown, the negative output 12 of the high voltage generator 1 or the positive output 23 of the high voltage generator 2 then being connected to the ground 0. The pronounced asymmetry between the anode voltage and the cathode voltage which occurs in the case of very small tube currents is then partly compensated for by the high internal resistance and the inequality of the cathode current and the anode current. In the case of very large tube currents, the value of the anode voltage and the cathode voltage may thus even become equal again. In that case, however, the tube current may be twice as large, in given circumstances even larger, than the tube current which would occur for the same tube voltage and the same filament temperature in the position of the high voltage switching device 9 which is shown in the drawing. When the internal resistance and the tube current are so large that a symmetrical voltage distribution is obtained on the X-ray tube 7 in spite of asymmetrical no-load voltages, the high switching device 9 may continuously remain in the indicated switching position (not shown).

The high voltage switching device is controlled by a control device 18. The control device 18 serves to switch the high voltage switching device 9 to the position which is shown in the drawing whenever the grid/cathode voltage difference would become so large that in the other position of the high voltage switching device 9, considering the given values of the internal resistance and the voltage of the high voltage generator 2 and the adjusted values of tube voltage and tube current, a high voltage overload would occur on the cathode side which could cause, for example, breakdowns.

In the case of a comparatively low internal resistance of the X-ray generator, the voltage distribution and the value of the cathode voltage are substantially independent of the tube current. In such cases it is sufficient to set the high voltage switching device 9 to the position shown as soon as the tube voltage adjusted by the operator exceeds a predetermined value. It is to be noted that switching over cannot be controlled in dependence of the smallest cathode voltage measured by lower measuring voltage divider 15, because in that case switching-over would have to take place in the presence of the tube voltage, that is to say during an exposure or during fluorscopy; this must be avoided. Switching-over should take place already before the selected tube voltage is switched on.

In high voltage generators having a very high internal resistance, however, it may be that in spite of asymmetrical no-load voltage the tube voltage is symmetrically distributed between the anode side and the cathode side, so that in that case (large tube currents) the high voltage switching device 9 may remain in the position which is not shown. However, if only one very small tube current flows, the voltage distribution on the X-ray tube 7 also becomes asymmetrical, so that switching-over is necessary. Therefore, switching over in dependence of the adjusted tube current then suffices.

Generally, however, it is advantageous to perform the switching-over in dependence of the tube voltage and the tube current. To this end, the control device 18 comprises a first switch 181 which is coupled to the adjusting element 19 for the adjustment of the tube voltage. The switch 181 connects each time one end of one of four resistors 182 (to the other end of which there is connected one of the four voltages $U_1 \ldots U_4$) to a second switch 183 which can be switched over to one of several resistors 184 of different value, the other end of which is connected to ground. The voltages $U_1 \ldots U_4$ are proportional to the voltage adjusted by means of the selector 19, whilst the resistors 184 are approximately inversely proportional to the current flowing via the grid 8 at the selected tube current, and hence also to the tube current itself. The resistors 182 should correspond to the internal resistance of the high voltage generator at the associated selected voltage. If the internal resistance is independent of this voltage, the resistors 182 can be omitted if instead the voltage $U_1$, $U_2$, $U_3$ and $U_4$ applied to the first switch 181 are supplied by a direct voltage generator having a corresponding internal resistance.

The voltage on the connection between the two switches 181 and 183 is higher as the adjusted tube voltage is higher and as the adjusted tube current is smaller. It is dependent on the adjusted values of tube current and tube voltage in the same way as the cathode voltage (in the position of the high voltage switching device 9 which is not shown) and is used for controlling the high voltage switching device 9. For this purpose there is provided a comparator circuit 185 which compares the voltage on the connection between the two switches 181 and 183 with a predetermined reference value $U_R$ and which switches the high voltage switching device 9 to the position shown when the reference value $U_R$ is exceeded, and switches it to the other position when this voltage decreases below the reference value $U_R$.

The control device 18 thus represents a simulation network which simulates the electrical conditions on the cathode of the X-ray tube 7 (in the position of the high voltage switching device 9 which is not shown). A simulation network of this kind may be omitted in X-ray generators in which the values of tube voltage and tube currents to be adjusted are digital values and in which a programmable digital arithmetic device is provided for control of the X-ray generator. Instead of using the simulation network, the cathode voltage is calculated by means of a program. The computer thus controls the high voltage switching device 9 in dependence of the calculated cathode voltage.

Figure 2:
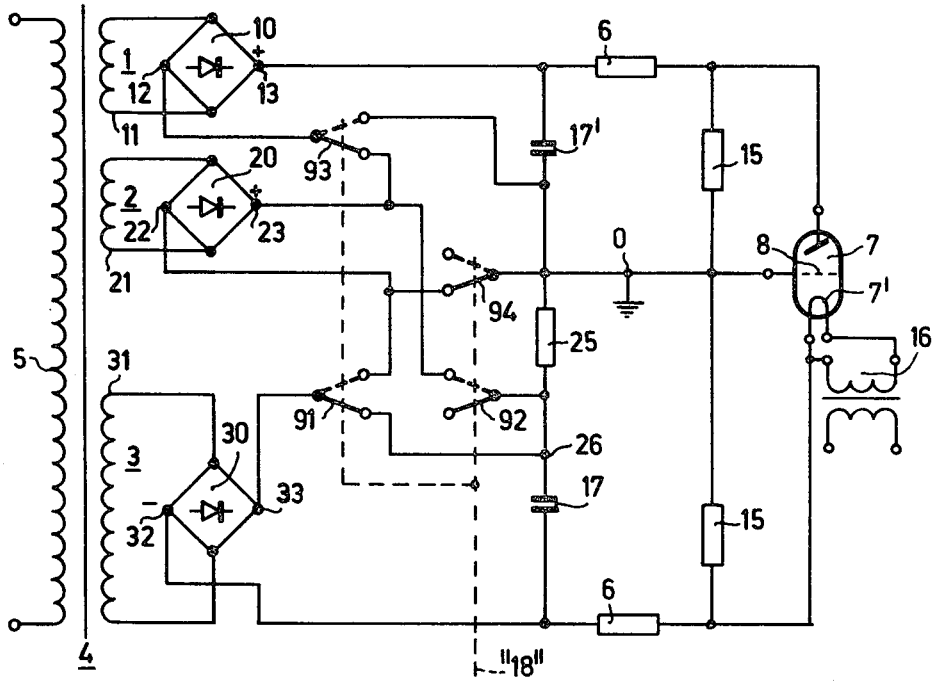
FIG. 2 shows an embodiment comprising an emission current measuring resistor.

FIG. 2 shows an embodiment comprising a measuring resistor 25 for measuring the tube current. It is known that the tube current of an X-ray tube can be readily measured by utilizing a resistor 25 which carries the tube current and one end of which is connected to ground 0. The tube current is the electric current which reaches the anode where it generates X-rays. In the described X-ray tubes, the cathode current is substantially equal to the tube current because the part of the electrons which reaches the grid 8 is negligibly small for all practical purposes. In the embodiment shown in FIG. 2, the measuring resistor 25 is connected between the two capacitors 17 and 17'. The high voltage switching device comprises four switching contacts 91 to 94. The switching contact 91 connects the positive output 33 of the high voltage generator 3 either to the negative output 22 of the high voltage generator 2 or to the junction 26 of the resistor 25 and the capacitor 17. The switching contact 92 either connects the junction 26 near the resitor 25 to the positive output 23 of the high voltage generator 2 or is open. The switching contact 93 connects the end of the resistor 25 which is connected to ground 0 either to the negative output 12 of the high voltage generator 1 or to the positive output 23 of the high voltage generator 2. The switching contact 94 either connects the negative output 22 of the high voltage generator 2 to ground 0 or is open. All contacts 91 to 94 can be simultaneously switched to the switching position which is shown or to the switching position which is denoted by broken lines by the control device 18 (FIG. 1) which is not shown in detail. In the switching position which is denoted by broken lines, the current flows from the positive output 33 of the high voltage generator 3 to the negative output 22 of the high voltage generator 2 via the switching contact 91. From the positive output 23 of the generator 2 the current flows to ground 0 via the switch 92 and the resistor 25. From ground 0, the current flows to the negative output 12 of the high voltage generator 1 via the switching contact 93. In this position, the series-connected high voltage generators 2 and 3 together supply the cathode voltage whilst the high voltage generator 1 supplies the anode voltage. In the switching position shown, the current flows to the junction 26 at one end of the resistor 25 via the contact 91 and, via the resistor 25 and the switching contact 94, to the negative output 22 of the high voltage generator 2 whose positive output 23 is connected to the negative output 12 of the high voltage generator 1 via the switching contact 93. The negative output 22 of the high voltage generator 2 is then connected to ground 0 via the switching contact 94, so that in this switching position the cathode voltage is supplied by the high voltage generator 3 whilst the anode voltage is supplied by the series-connected high voltage generators 1 and 2 together.

In order to measure the tube current in the embodiment shown in FIG. 2, it is not only necessary to extend the high voltage switching device (91, 92, 93, 94) by three further switching contacts which are not required in the embodiment shown in FIG. 1, but the switching contacts must also be insulated with respect to one another due to the high voltage supplied by the high voltage generator 2. This is because in the switching position which is denoted by uninterrupted lines, the potential on the switching contacts 91, 92 and 94 with the direct voltage generated by the high voltage generator 3 is lower than the potential on the switching contact 93. In the other switching positions (denoted by broken lines), the potential of the switching contact 91 is lower than the potential of the contacts 92, 93 and 94.

Even though the invention has been described with reference to an embodiment with a single-phase transformer, it can also be used for X-ray generators comprising multi-phase high voltage transformers.

What is claimed is:

1. An X-ray generator for an X-ray tube comprising a grounded grid which is situated between the anode and the cathode thereof, said X-ray generator comprising a series connection of high voltage generators which are to be connected to the anode and the cathode of the X-ray tube in order to generate a direct voltage on the X-ray tube, and also comprising means for changing the ratio of the anode voltage and the cathode voltage, characterized in that the series connection consists of at least three high voltage generators (1, 2, 3), there being provided a high voltage switching device (9) whereby an output junction of two interconnected high voltage generators can be connected to ground, the high voltage switching device (9) being switchable in dependence of the adjusted value of the tube voltage and/or the tube current on order to ensure that the ratio of the anode voltage and the cathode voltage is smaller in the case of low values of the tube voltage than in the case of high values of the tube voltage and that a given value of the cathode voltage is not exceeded.

2. An X-ray generator as claimed in claim 1, characterized in that each high voltage generator (1, 2, 3) comprises a secondary winding (11, 21, 31) of a high voltage transformer (4) which is connected to a rectifier device (10, 20, 30).

3. An X-ray generator as claimed in claim 1 or 2, characterized in that the series connection comprises three high voltage generators (1, 2, 3), the positive output (33) of the high voltage generator (3) whose negative output (32) is connected to the cathode of the X-ray tube and the positive output (23) of the high voltage generator (2) which is connected to this high voltage generator being coupled to the high voltage switching device (9).

4. An X-ray generator as claimed in claim 3, characterized in that the high voltage generator (3) which is connected to the cathode is composed of a series connection of two identical high voltage generators and of which the output voltage is twice as high as the high voltage of each of the other high voltage generators (1, 2).

5. An X-ray generator as claimed in any of claim 1 or claim 2 or claim 4, characterized in that there is provided a tube current measuring resitor wherethrough the current generated by at least one of the high voltage generators (3) flows, the tube current measuring resistor being coupled to the high voltage switching device (91, 92, 93, 94), a first connection of the tube current measuring resistor being connected to ground potential, the second connection being connected via the high voltage switch (91, 92) either to the positive output of the second generator (2) or to the positive output of the third generator (3) either the negative output of the first generator (1) or the negative output of the second (2) respectively, then being connected to ground potential.

* * * * *